US012570459B2

(12) United States Patent
Wang

(10) Patent No.: US 12,570,459 B2
(45) Date of Patent: Mar. 10, 2026

(54) STRING- OR STRAP-BASED HANGER SYSTEM FOR CONTAINER

(71) Applicant: WENHUA (Hamburg) Container Technical Service GmbH, Hamburg (DE)

(72) Inventor: Heran Wang, Hamburg (DE)

(73) Assignee: WENHUA (Hamburg) Container Technical Service GmbH, Hamburg (DE)

( * ) Notice: Subject to any disclaimer, the term of this patent is extended or adjusted under 35 U.S.C. 154(b) by 0 days.

(21) Appl. No.: 18/598,640

(22) Filed: Mar. 7, 2024

(65) Prior Publication Data

US 2024/0300726 A1 Sep. 12, 2024

(30) Foreign Application Priority Data

Mar. 7, 2023 (DE) ..... 10 2023 105 673.5
Oct. 31, 2023 (EP) ..... 23207067

(51) Int. Cl.
*B65D 85/18* (2006.01)
*B65D 90/00* (2006.01)

(52) U.S. Cl.
CPC ..... *B65D 85/185* (2013.01); *B65D 90/0053* (2013.01)

(58) Field of Classification Search
CPC ..... B65D 85/185; B65D 90/0053
See application file for complete search history.

(56) References Cited

U.S. PATENT DOCUMENTS 1,172,937 A * 2/1916 Butcher ..... A47G 25/743 D8/367
2,609,104 A * 9/1952 Leach ..... B60R 7/10 224/927
2,941,672 A * 6/1960 Lathrop ..... A47G 25/02 211/85.3

(Continued)

FOREIGN PATENT DOCUMENTS

CN 2592566 Y 12/2003
CN 206750614 U 12/2017

(Continued)

OTHER PUBLICATIONS

Https://www.usfutaba.com/wp-content/uploads/2019/08/USF-Catalog-2019-65.pdf (Aug. 14, 2022, via Internet Archive) (Year: 2022).*

(Continued)

*Primary Examiner* — Shaun R Hurley
(74) *Attorney, Agent, or Firm* — J. Peter Paredes; Amin Wasserman Gurnani LLP

(57) ABSTRACT

The invention relates to a string- or strap based hanger system for containers, comprising a main hanger bar, suited to be attached to a holding structure connected to a shipping container and dimensioned to spanning the entire width of the container, and a plurality of vertical item hangers coupled to said hanger bar and extending from the main hanger bar in a general direction downward. The hanger system further comprises a top plus hanger and at least one horizontal item hanger to hold at least one horizontal item hanger arrangeable along an extension direction of the second hanger bar and preferably located between a first and a top plus vertical item hanger of the main hanger bar.

14 Claims, 5 Drawing Sheets

(56) References Cited

U.S. PATENT DOCUMENTS

| | | | | | |
|---|---|---|---|---|---|
| 3,963,290 | A * | 6/1976 | Rennemann | B65D 90/0053 | 312/351 |
| 4,538,738 | A * | 9/1985 | Van Iperen | B65D 90/0053 | 206/289 |
| 4,821,879 | A * | 4/1989 | Kupersmit | B65D 85/185 | 206/386 |
| 2012/0048816 | A1* | 3/2012 | Brown | A47G 29/00 | 211/34 |
| 2021/0094756 | A1* | 4/2021 | Larkins | A47B 96/14 | |

FOREIGN PATENT DOCUMENTS

| | | | | |
|---|---|---|---|---|
| JP | 2012085947 | A | * | 5/2012 |
| KR | 870001070 | Y1 | | 3/1987 |
| TW | M541801 | U | * | 5/2017 |

OTHER PUBLICATIONS

Translation TW M541801.*
Translation JP 2012085947.*

* cited by examiner

STRING- OR STRAP-BASED HANGER SYSTEM FOR CONTAINER

CROSS-REFERENCE TO RELATED APPLICATIONS

The present application claims priority to German application serial no. DE 10 2023 105 673.5 filed on Mar. 7, 2023, and EP23207067.2 filed on Oct. 31, 2023, each herein incorporated by reference in their entireties.

BACKGROUND OF THE INVENTION

The invention refers to a string- or strap-based hanger system for containers.

Conventional hanger systems with stitched straps or knotted strings are used to vertically hang multiple garments overlapping each other. In order to transport garments, they are commonly stored in a hanging state, hanging from a holding bar in a container. The number of knots in the string or the number of stitched sections in the strap define the number of garments that can be held by one string or strap. Of course, to reduce transportation costs, containers are to be filled with as many garments as possible. Therefore, considering the standard dimensions of a regular container for international shipment, multiple garments are hung on vertical holding strings or straps. In order to increase the number of garments transported in the container, either more holding structures for attaching the strings and straps or more knots or stitched sections are commonly provided.

However, such approaches are limited by the size of the garment to be transported.

Unused space in transportation results in more transportation efforts and thus higher energy consumption. Accordingly, environmental impact and possibly damage to the environment are increased.

It is therefore an objective of the present invention to improve the prior art, increase space usage within a transportation container and thereby reduce environmental impact due to transportation of hanging items.

SUMMARY OF THE INVENTION

This objective is met with a hanger system for containers and a container according to the independent claims. Advantageous developments are subject to the dependent claims.

In general terms, the invention allows to add hanging garments between two fully stocked vertical item hangers, thus using the space in the upper section of a container by exploiting the fact that a distance between garments in the upper part of subsequent vertical item hangers is bigger than the distance of the garment in the middle and lower part of the vertical item hanger. This is due to the fact that in the middle and lower part, multiple garments are overlapping, which eventually leads to a maximum number of garments to be loaded next to each other in a width direction of the container. To put it differently, the more garments are overlapping, the more they bulge out, using all space available in a width direction of the container, while in the upper section, no or little overlapping occurs between subsequent item hangers and there will be unused available space.

According to preferred embodiments of the invention, a hanger system for containers is provided, comprising at least a first hanger bar and holding means. The first hanger bar is attached to the holding means and the holding means are connectable to a support provided on a shipping container. Depending on the specific container, the first hanger bar has a width corresponding to the width of such a container, for example a standard 40 feet container. In metric units, such a standard 40 feet container typically has a length of approximately 12.2 meters in length, approximately 2.4 meters in width, and approximately 2.6 meters in height. These dimensions are commonly used in the international shipping and logistics industry for transporting a wide variety of goods across the globe. The hanger bar according to the present invention is dimensioned to span the entire inner width of the container from one of its sidewalls to the other such that it is held by the support structure fastened to the container.

At least one, preferably a plurality of, vertical item hangers is coupled to said first bar. The vertical item hangers extend, i.e., hang, from the first bar in a general direction downward.

In preferred embodiments, the hanger system further comprises a second hanger bar. The hanger system further comprises at least one horizontal item hanger arranged on the second hanger bar. In use, one, two, or multiple horizontal item hangers are provided along the second hanger bar in its direction of extension, positioned such that they are situated at positions between a first and a second vertical item hanger when looking onto the hanger system from a direction perpendicular to the extension direction of the first and the second hanger bar, i.e., in a length direction of a container equipped with the hanger system.

Preferably, the second hanger bar is arranged in parallel, or essentially in parallel, to the first hanger bar. This can allow to improve usage of the void spaces within a shipping container.

In other embodiments it is possible that no second hanger bar is provided and one or multiple horizontal item hangers are provided on the first hanger bar between adjacent vertical item hangers.

In at least one embodiment of the invention, the vertical item hangers are straps. A strap is formed to a loop and in predefined distances from one another, two layers of the strap are stitched together, that way forming a section with a closed loop to accommodate a garment holder. This is repeated along the length of the strap to form a predetermined number of sections, for example 8 sections or 16 sections, but any other number may be provided, depending on the specific items, in particular garments, to be transported. As an alternative to straps, strings could be used as vertical item hanger. The strings could also be treated with stitches rather then provided with knots, or any other suitable technique for creating a robust holder. In a further alternative embodiment, strings or straps are provided with knots, instead of stitches, that way forming said sections.

With a fully loaded strap or string, according to the invention and due to the overlapping of the garments hanging on the string or strap, the space needed for the garments is inhomogeneous in the vertical direction. This typically leaves unused space in an upper part of the shipping container, as garments provided in the upper knots or sections of the string or strap will overlap with garments provided below. With the amount of overlapping garments increasing for lower knots or sections. Using such standard transportation equipment therefore results in void space in an upper part close to the hanger bar on top of the container. A hanger system according to the invention allows to make use of that unoccupied space and therefore allows to efficiently exploit the transportation capacities of a container.

A first hanger bar according to the invention may also be referred to as a main bar of the hanging system. The second hanger bar may likewise also be referred to as a top plus hanger bar and the entire hanger system may be referred to as a string- or strap-based top plus hanger system.

Preferably, in the hanger system according to the invention, in use, vertical item hangers and horizontal item hangers are arranged alternately, with at least one horizontal item hanger, preferably two, more preferably multiple, horizontal item hangers, arranged between the vertical item hangers when viewing the system from a frontal view, i.e., a perspective perpendicular to the main extension direction of the system, for example in a direction along the length of the shipping container. That way, ideal use of the available space in the upper portion of the container can be made, thereby increasing the used volume of the container. Preferably, at least one of the hanger bars, the first hanger bar and/or the second hanger bar of the hanger system, is provided with a scale, e.g., a mark-up, a carving or similar indicator, predefining positions for receiving the respective item hangers. That way, a pre-definition of the space usage can be provided, helping when loading the hanger system during use.

Horizontal item hangers are means to receive at least one piece of garment and are suitable to hold the garment close to the respective bar, i.e. the second hanger bar. The horizontal item hangers preferably include such structures that allow connecting or fastening of one or multiple pieces of garment to the second hanger bar, such as cable tie or other retainers. Horizontal item hangers differ from vertical item hangers in that vertical item hangers in use hold a plurality of items with subsequent items having a vertical offset with respect to the adjacent items, while horizontal item hangers are designed to be distributed preferably single file along the horizontal hanger bar.

In some embodiments of the invention, the horizontal item hangers might have one or multiple additional vertical sections to also receive a limited amount of garments in a vertical direction, depending on what kind of garments shall be transported.

The invention also refers to a container for transportation comprising at least one such hanger system.

Basically, the suggested hanging system provides a structure to use the topmost space of a container by providing means to store items closer to the hanger bars than existing systems.

In general terms, the invention allows to add hanging garments between two fully stocked vertical item hangers, thus using the space in the upper section of a container.

In a preferred embodiment, the invention relates to a second hanger bar, preferably having a circular cross section—which may be referred to as Circular Bar Plus—in addition to the single bar comprising strings or straps as vertical item hangers in a Garment On Hanger (GOH) System of strings/straps for shipping containers.

As already discussed, according to the current situation a single bar with strings/straps Garment On Hanger system is the usual and common structure for international transportation of hanging garments in containers. Depending on the side from which a loading of the vertical item hangers is provided, e.g., from the right hand side, the most loaded item on the respective other side, of the container, e.g., the left most item hanger, significantly bulges out in lower parts of the vertical item hanger. Adjacent loaded vertical item hangers will therefore compete for the space in bulged-out segments, but leaving significant space available in its upper part. According to the invention this void space can be occupied with additional garments.

Further, according to the invention, the hanger system comprises holding means to be connected to a transport container. These holding means preferably are V-steel rails. When applied, the holding means are connected with a support of the container, e.g., lashing rings. The first hanging bar of the hanger system preferably is a rectangular bar coupled to the holding means, i.e., coupled on the V-Steel rails. Vertical item hangers such as strings or straps are fastened to the hanging bar. The strips or straps are provided with stitches or knots, creating loops capable of receiving hanging garments on the knots/stitches of the strings/straps.

In order to load and hang more garments into the container, so far, one method is to add one to several main bars, i.e., rectangular bars. The other is to add more knots/stitches on the string/strap. But these methods are subjected to the width of garment and the inside height of the container, respectively.

According to the invention, new space is found and made available for further hanging garment.

According to the Invention, in the hanger system, or GOH string/strap system, the garments are hung one by one, knot by knot or stitch by stitch, on the strings or straps tied on the rectangular bars in the container.

In the conventional existing single bar systems, the knots and stitches create numerous nodes in the air, which efficiently utilizes the space of the container especially in the part of middle and lower height, because many tiers of garments are overlapped. It is one essential finding of the present invention that there is vacant space left unused and how to exploit that space, which is the part of upper height, where less tiers of garments are overlapped, because near to the rectangular main bar it is the starting phases of knots/stitches.

Accordingly, in the part of middle and lower height of the shipping container, the space is tight or even crowded, while the upper part has significant void space in comparison.

When defining the individual nodes available for receiving hanging garment from top to bottom with numbers starting with 'one' for the topmost node in conventional hanging systems, the invention provides above the top number one node, i.e., the uppermost knot or stitch, a top number 'zero' node for hanging garments and thus allows use of the free upper space remaining unused between the vertical item hangers.

In a preferred embodiment of the invention, on the holding means, e.g., the V-Steel rails of the existing system, a second hanger bar is provided. Advantageously, the second hanger bar is a circular steel bar. The second hanger bar, e.g., the steel bar, has a diameter of 2.5 to 6.6 cm, preferably 3 to 4 cm, preferentially 3.3 cm. Further, the second hanger bar preferably is placed in a distance from the cross-sectional center of the first hanger bar to the cross-sectional center of the second hanger bar of 3 to 30 cm, more preferably at a distance of 5 to 8 cm center to center, more preferably a distance of 6 to 7 cm center to center, preferentially at about 6.6 cm center to center. In that, the cross-sectional center relates to the center of the cross section of the respective bar. For a circular bar, that cross sectional center would be the center of the circle forming the cross section of the bar. For a rectangular bar, the cross section would be a rectangle, the cross sectional center thereof being the intersection of the diagonals of the rectangle.

The second hanger bar may be provided such that garments can be hanged directly instead of on a knot/stitch. The second hanger bar may be provided with pre-installed or pre-fastened horizontal item hangers or with fasteners to hang items, preferably garments, horizontally distributed on the second hanger bar. Such fasteners to hang garments could be cable tie or other retainers. Other horizontal item hangers can also be used and be pre-installed or pre-fastened to the second hanger bar. The horizontal item hangers may also be fastened after installing the second hanger bar. In particular, the horizontal item hangers may comprise a cable tie or other retainers. The horizontal item hangers may be provided for one-time use, e.g., having to be destroyed after use to release the garments. The horizontal item hangers may also be provided for multiple use.

In at least one embodiment of the invention, the second hanger bar further comprises a retaining element. The retaining element is designed to comprise a concave section suitable to receive a part of the outer circumference of the second hanger bar, i.e., covering the second hanger bar along a part of its circumference in a form-fitting manner and along a defined length of the second hanger bar. The retaining element further comprises at least one, preferably multiple, fixing elements, which allow fixing of the retaining element to the second hanger bar. By fixing the retaining element to the second hanger bar while the horizontal item hangers are attached to the second hanger bar, the retaining element also fixes the horizontal item hangers to the second hanger bar. The fixing element can be provided for one-time use, such as a cable retainer. In other embodiments, the fixing element may also be a reusable element. Further, the retaining element and the fixing element can be fixedly coupled to another. Such a retaining element can allow an improved security of the hanging garments during rough transport conditions such that an accidentally falling down and thereby soiling or damaging the garment can be reduced.

Relatively speaking, to the nodes top one/two/three . . . knots/stitches, the plus of the extra circular bar actually acts as the node top number zero knot/stitch.

As a result of providing a top zero node, in the upper space between garments on two adjacent strings/straps, one, two, or multiple pieces of garment can be inserted. Thus the original void space can be utilized more efficiently.

Considering common string/strap GOH systems, vertical item hangers with 8 or 16 knots/stitches are used, thus, on average, 12 garments per vertical item hanger. Assuming that two additional pieces of garment can be hanged on the hanger system according to the invention, in particular on a second hanger bar, e.g., the circular bar plus, this means approximately an increase of 2/12=16.67% transportation efficiency. Hence, both transportation costs can and environmental impact can be reduced.

In some embodiments of the invention, the hanger system comprises a holding structure for attachment to a container, a first hanger bar and a second hanger bar, further comprising vertical item hangers attached to the first hanger bar and at least one, preferably two, more preferably multiple horizontal hanger bars for each vertical hanger bar, attached to the second hanger bar.

The invention also refers to a container having installed at least one hanging structure as described.

It should be noted, that the invention as laid out herein does not require to be applied to a standard 40-feet container as exemplified above. It will be understood that the invention may easily be applied to other transportation containers, boxes or storages, without having to depart from the idea of the invention.

BRIEF DESCRIPTION OF THE FIGURES

In the following, exemplary embodiments of the invention are provided, showcasing various ways to realize its potential. The figures are not intended to limit the scope of the invention, which is solely defined by the claims for protection. In the figures

Reference signs in the different figures refer to same or similarly acting elements, if not indicated differently. The description thereof is only repeated, if this helps understanding the invention better or to emphasize differences between individual figures or embodiments.

DETAILED DESCRIPTION

Figure 1:
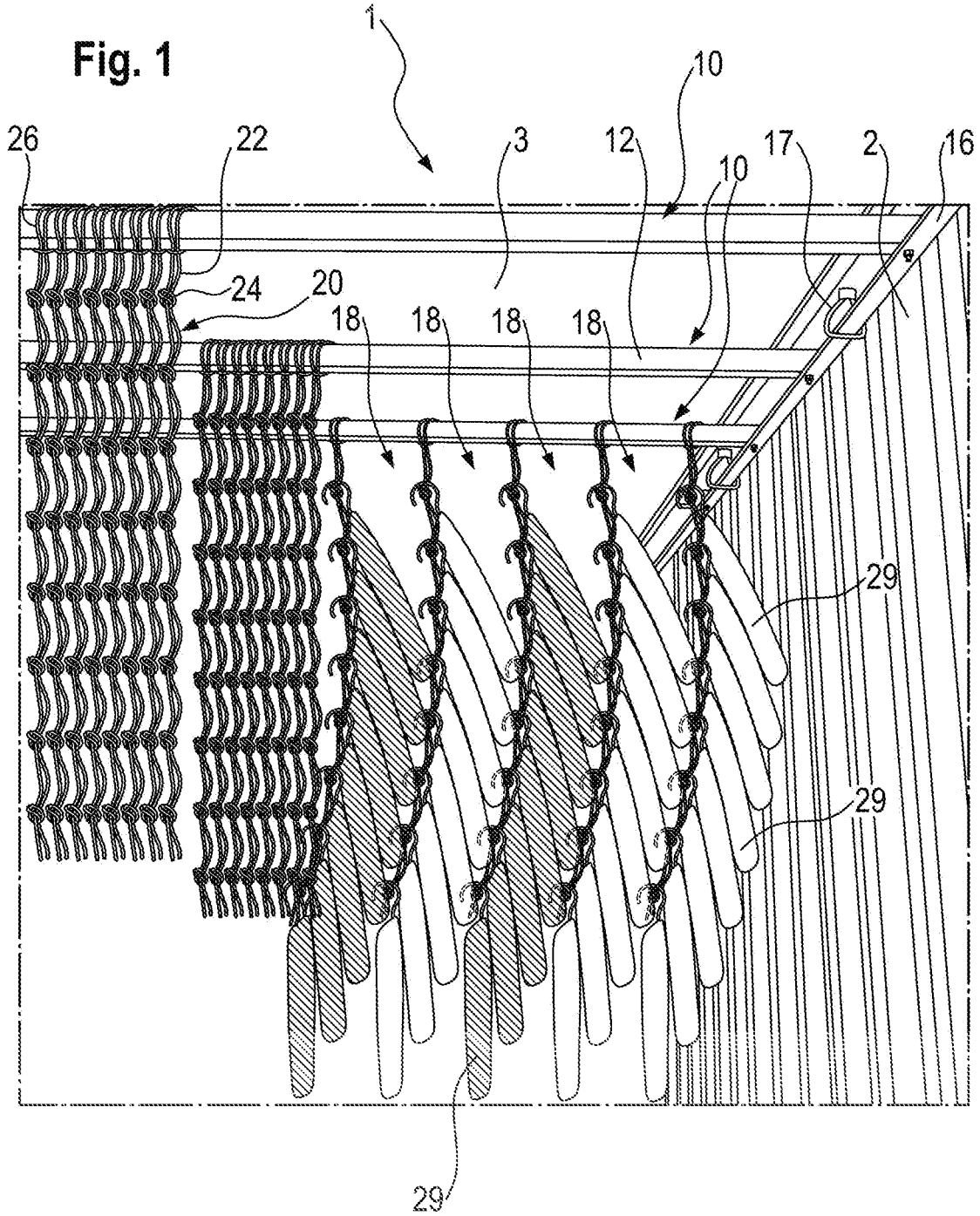
FIG. 1 is a container for transporting hanging garment according to one embodiment.

FIG. 1 is a container 1 for transporting hanging garment 29. Within the container 1, along a sidewall 2 and close to a ceiling 3 extends along the length direction of the container a holding means 16. The holding means 16 preferably is designed as a V-steel rail to enable for heavy loading. The holding means 16 are supported by supports 17, e.g. lashing rings, which are distributed in regular distances along the sidewall 2. In a width direction of the container 1, from one sidewall 2 to the other sidewall, a hanger system 10 is provided. The hanger system 10 in the embodiment of FIG. 1 comprises a plurality of first hanger bars 12. The first hanger bars 12 are provided with a plurality of vertical item hangers 20, having stitches or knots, creating loops capable of receiving hanging garments on the knots/stitches of the string/strap as described in more detail in FIG. 2*a* and FIG. 2*b*. The first hanging bars 12 of the hanger system preferably are rectangular bars coupled to the holding means 16, i.e., coupled on the V-Steel rails. The vertical item hangers, such as strings or straps are fastened to the hanging bar.

The first hanger bars 12 are distributed in parallel to another along the ceiling 2 of the container 1 in a distance allowing the placement of one garment element 29 hanging from one first hanger bar 12 next to a garment element 29 hanging from the adjacent first hanger bar 12. Preferably, there is little to no space between the garment elements 29 in the length direction of the container 1, so that the space is used as efficiently as possible.

As can be seen in the upper part of the container, close to the hanger bar 12, void spaces 18 are formed which remain unused in conventional hanger systems, compared with the part of middle and lower height.

Figure 2A:
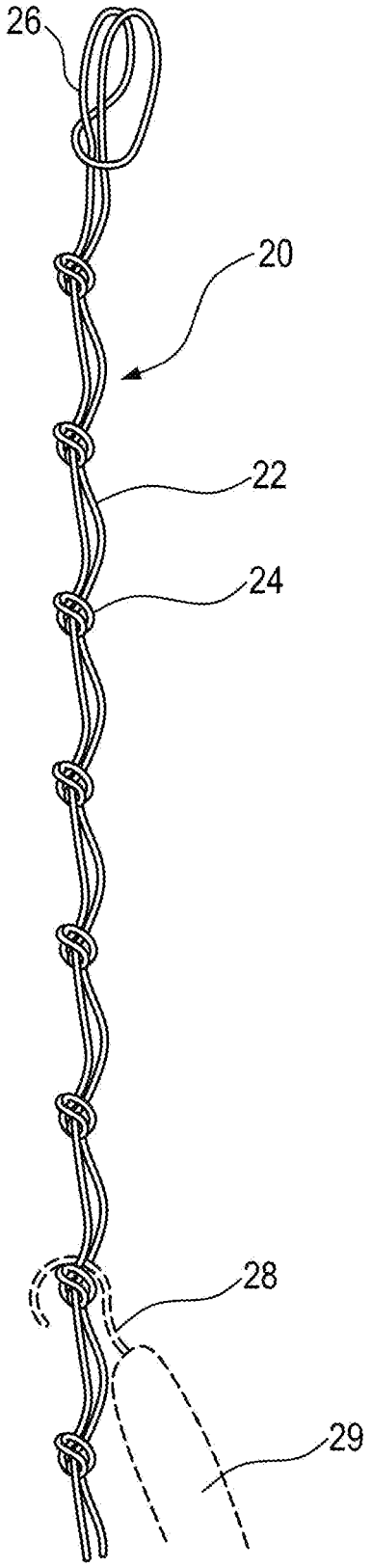
FIGS. 2*a*-2*b* shows known vertical hangers FIG. 2*a*) as strings and FIG. 2*b*) as straps.

FIG. 2*a* shows an embodiment of a vertical item hanger 20, wherein the vertical item hanger 20 is a string. The string is provided as a double strand with multiple knots 24, with two adjacent knots forming a loop 22 in the double strand string. In order to fasten the vertical item hanger 20 at the first hanger bar, a loop 22 is also formed in an end section of the vertical item hanger 20, forming a holding section. The material of the string-like vertical item hanger 20 preferably is polypropylene. Of course, other materials can also be used.

Figure 2B:
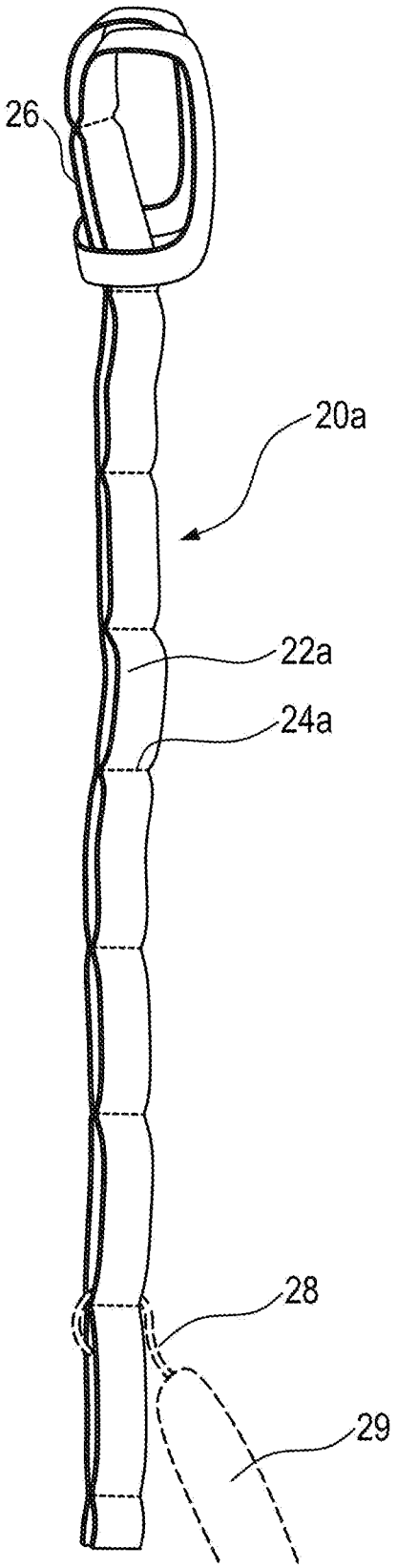

FIG. 2*b* shows another embodiment of vertical item hanger 20*a*, wherein the vertical item hanger 20*a* is a strap. The strap, like the string 20, is provided as a double strand or shaped as a long loop formed by a long strap folded back on itself. Along the strand, multiple seams 24*a* are provided in predefined distances from one another and spanning the width of the strap. The seams 24*a* fix the two strands of the strap to each other, thereby, like the knots 24, forming loops 22*a* between two adjacent seams 24*a* or between the last seam 24*a* with the folding section of the strap.

By forming the loops 22, 22*a* in the vertical item hanger 20, 20*a*, a garment hanger 28 can be placed in such a loop 22, 22*a* and find support in the knot 24 or the seam 24*a* as the case may be. One vertical item hanger 20, 20*a* commonly is equipped with 8 or 16 knots, while in the embodiments shown herein typically 8 knots are displayed for better visibility of properties.

The vertical item hangers 20, 20*a* further comprise a holding section 26. The holding section 26 is provided for fixing and holding the vertical item hangers 20, 20*a* at the first hanger bar 12.

Figure 3:
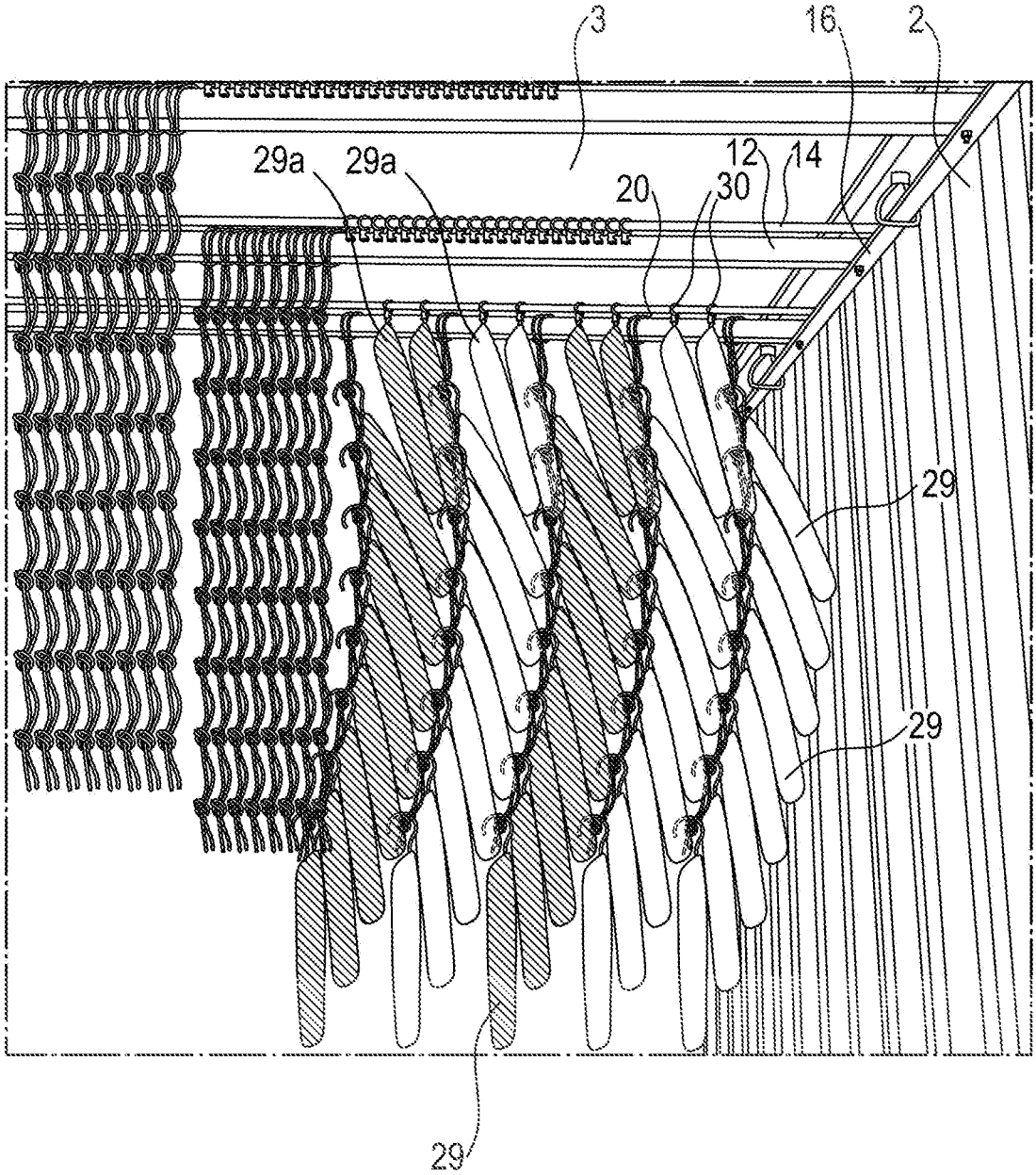
FIG. 3 is a container for transporting hanging garment according to a further embodiment.

FIG. 3 shows a container 1 with a hanger system 10 which, on the V-Steel rails of the system as shown in FIG. 1, comprises in addition to a first hanger bar 12 a second hanger bar 14. As described earlier, the first hanger bars 12 are equipped with vertical item hangers 20. The second hanger bars 14 are provided as circular steel bars in the embodiment shown in FIG. 3 and again more clearly visible in FIG. 4.

The second hanger bars 14 are equipped with horizontal item hangers 30. When looking in a length direction of the container 1, which is a direction perpendicular to the extension direction of the first and second hanger bars, the vertical item hangers 20 are positioned spaced apart from another as already shown in FIG. 1, in order to receive a number of garment elements 29 corresponding to the number of loops 22 formed in the vertical item hanger 20. The space thereby created in the upper region of the container, i.e., the region of the top knots of the vertical item hanger 20, is used for placing a predefined number of garment elements 29*a* at the second hanger bar 14. Thus, the horizontal item hangers 30 are placed intermittently between the vertical item hangers 12 while at the same time alternating between the first hanger bar 12 for a vertical item hanger 20, and the second hanger bar 14 for a horizontal item hanger 30.

Considering that the strings/straps as described in FIGS. 2*a* and 2*b* comprise knots/stitches forming the nodes top one/two/three . . . , the horizontal item hangers 30 on the second hanger bar 14 actually act as the node top number zero knot/stitch. That way the number of garments may be increased, as the number of available nodes is increased.

Figure 4:
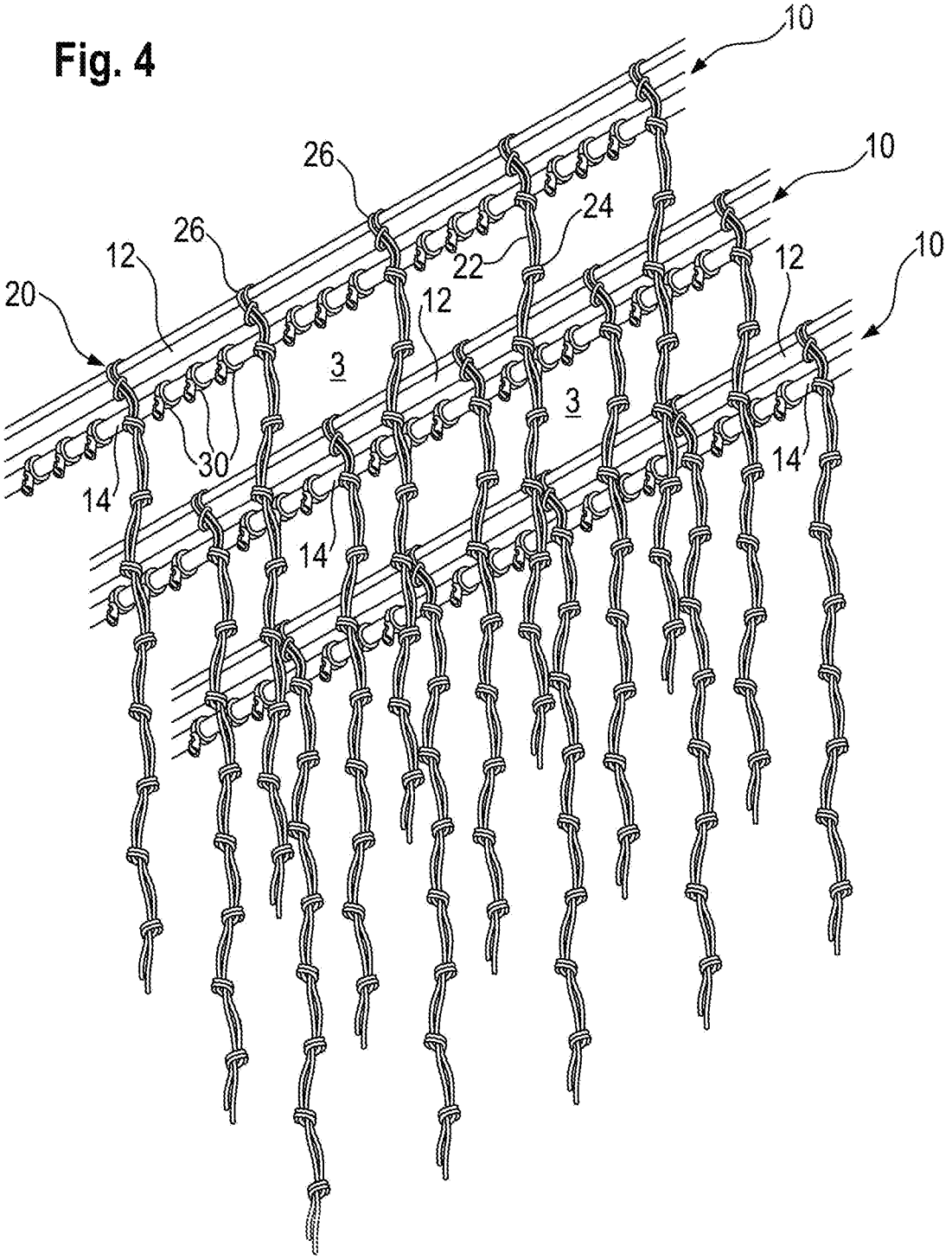
FIG. 4 is a view upward to the ceiling in a container according to an embodiment.

FIG. 4 shows the hanger system in a view from below toward the ceiling 3 of the container 1. As shown in FIG. 4 in greater detail, the first hanger bar 12 and the second hanger bar 14 are set at a distance to another, which is big enough to allow the equipping of the second hanger bar with horizontal item hangers but only as wide as necessary, in order to save as much space as possible. That way, the void spaces 18 as visible in particular FIG. 1 available in the upper region of the container can be used more efficiently.

The second hanger bar 14 has a diameter of 2.5 to 6.6 cm, preferably 3 to 4 cm, preferentially 3.3 cm. The second hanger bar 14 is placed in a distance center to center of the first hanger bar 12 and the second hanger bar 14 of 3 to 30 cm apart from the first hanger bar 12. More specifically, the preferred distance is 5 to 8 cm center to center of the respective hanger bars 12, 14. More preferably the distance is 6 to 7 cm center to center. Preferentially the distance from the cross sectional center of the second hanger bar 14 is about 6.6 cm from the cross-sectional center of the next first hanger bar 12.

Figure 5:
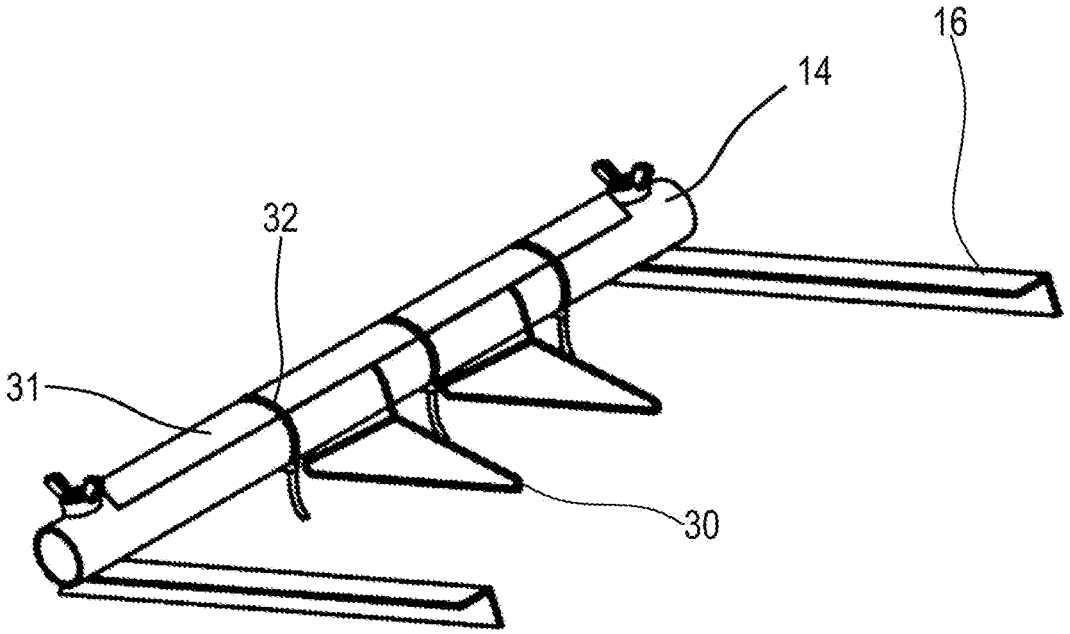
FIG. 5 is an embodiment of a second hanger bar with a retaining element.

FIG. 5 shows an embodiment of the second hanger bar 14 fixed to the holding means 16. In this embodiment, the horizontal item hangers are exemplified as clothes hangers. The second hanger bar further comprises a retaining element 31, partially covering the horizontal item hangers 30. The retaining element 31 comprises fixing elements 32, which allow fixing of the retaining element to the second hanger bar. By fixing the retaining element 31 to the second hanger bar 14 while the horizontal item hangers 30 are attached to the second hanger bar, the retaining element 31 fixes the horizontal item hangers 30 to the second hanger bar 14. The fixing element 32 in the embodiment shown is exemplified as a cable retainer, for one time use. In other embodiments, the fixing element may also be a reusable element. Further, the retaining element 31 and the fixing element 32 can be fixedly coupled to another. It is to be noted that FIG. 5 is not to scale. As previously discussed, the second hanger bar 14 may comprise a plurality of horizontal item hangers 30 distributed along the entire length of the second hanger bar, according to the requirements of the specific transport planned.

REFERENCE SIGN LIST

1 container
2 container side wall
3 container ceiling
10 hanger system
12 first hanger bar
14 second hanger bar
16 holding means/V-Steel rails
17 support
18 void space
20, 20*a* vertical item hangers
22, 22*a* knot/stitch
24, 24*a* hanger loop
26 holding section
28 garment hanger
29, 29*a* garment element
30 horizontal item hangers
31 retaining element
32 fixing element

The invention claimed is:

1. String- or strap-based hanger system (10) for containers (1), comprising a first hanger bar (12) and holding means (16), wherein the first hanger bar is attached to the holding means (16), and wherein the holding means are connectable to a support (17) of a shipping container (1), wherein the first hanger bar is dimensioned to spanning the entire inner width of the container (1), and a plurality of vertical item hangers (20, 20*a*) are coupled to said first hanger bar (12) and extending from the first hanger bar (12) in a general direction downward, wherein the vertical item hangers (20, 20*a*) in use hold a plurality of items with subsequent items having a vertical offset with respect to the adjacent items, wherein the vertical item hangers (20, 20*a*) are straps or strings, characterized in that the hanger system (10) further comprises a second hanger bar (14) arranged parallel to the first hanger bar (12); and multiple horizontal item hangers (30) coupled to said second hanger bar (14), wherein the multiple horizontal item hangers (30) is-are arrangeable along an extension direction of the second hanger bar (14), and are situated at positions between adjacent vertical item hangers (20, 20*a*) arranged on the first hanger bar (12) to make use of an unoccupied space in the upper part of the container (1) between the adjacent vertical item hangers (20, 20*a*); and wherein the multiple horizontal item hangers (30) provide top number zero nodes for hanging garments (29*a*) above the topmost node of the adjacent vertical item hangers (20, 20*a*).

2. Hanger system (10) according to claim 1, characterized in that the second hanger bar (14) is a circular steel bar.

3. Hanger system (10) according to claim 1, characterized in that the second hanger bar (14) has a diameter of 2.5 to 6.6 cm.

4. Hanger system (10) according to claim 3, characterized in that the second hanger bar (14) is placed in a distance from the cross-sectional center of the first hanger bar (12) to the cross-sectional center of the second hanger bar (14) of 3 to 30 cm.

5. Hanger system (10) according to claim 1, characterized in that the second hanger bar (14) comprises a retaining element (31) adapted to partially covering the second hanger bar (14) and the horizontal item hangers (30), such that by fixing the retaining element (31) to the second hanger bar (14), the horizontal item hangers (30) attached to the second hanger bar (14) are also fixed to the second hanger bar (14).

6. Hanger system (10) according to claim 5, characterized in that the retaining element (31) comprises at least one fixing elements (32), adapted to fixing the retaining element (31) to the second hanger bar (14).

7. Container (1) for transportation comprising at least one hanger system (10) according to claim 1.

8. Hanger system (10) according to claim 1, characterized in that vertical item hangers (20, 20*a*) and horizontal item hangers (30) are arranged alternately, with at least one horizontal item hanger (30) provided in a width direction between the vertical item hangers (20, 20*a*) when viewed in a direction perpendicular to the first hanger bar (12).

9. Hanger system (10) according to claim 1, characterized in that the second hanger bar (14) comprises a scale indicating predefined positions for vertical item hangers (20, 20*a*) and/or for horizontal item hangers (30).

10. Hanger system (10) according to claim 1, characterized in that the first hanger bar (12) comprises a scale indicating predefined positions for vertical item hangers (20, 20*a*) and/or for horizontal item hangers (30).

11. String-or strap-based hanger system (10) for containers (1), comprising a first hanger bar (12) and holding means (16), wherein the first hanger bar is attached to the holding means (16), and wherein the holding means are connectable to a support (17) of a shipping container (1), wherein the first hanger bar is dimensioned to spanning the entire inner width of the container (1), and a plurality of vertical item hangers (20, 20*a*) coupled to said first hanger bar (12) and extending from the first hanger bar (12) in a general direction downward, wherein the vertical item hangers (20, 20*a*) in use hold a plurality of items with subsequent items having a vertical offset with respect to the adjacent items, wherein the vertical item hangers (20, 20*a*) are straps or strings, characterized in that the hanger system (10) further comprising multiple horizontal item hangers (30), wherein the multiple horizontal item hangers (30) are arrangeable along an extension direction of the first hanger bar (12) and are situated at positions between adjacent vertical item hangers (20, 20*a*) arranged on the first hanger bar (12) to make use of an unoccupied space in the upper part of the container (1) between the adjacent vertical item hangers (20, 20*a*); and wherein the multiple horizontal item hangers (30) provide top number zero nodes for hanging garments (29*a*) above the topmost node of the adjacent vertical item hangers (20, 20*a*).

12. Hanger system (10) according to claim 11, characterized in that vertical item hangers (20, 20*a*) and horizontal item hangers (30) are arranged alternately, with at least one horizontal item hanger (30) provided in a width direction between the vertical item hangers (20, 20*a*) when viewed in a direction perpendicular to the first hanger bar (12).

13. Hanger system (10) according to claim 11, characterized in that the first hanger bar (12) comprises a scale indicating predefined positions for vertical item hangers (20, 20*a*) and/or for horizontal item hangers (30).

14. Container (1) for transportation comprising at least one hanger system (10) according to claim 11.

* * * * *